US011263979B2

(12) United States Patent
Yang

(10) Patent No.: US 11,263,979 B2
(45) Date of Patent: Mar. 1, 2022

(54) ORGANIC LIGHT-EMITTING DIODE DISPLAY WITH VOLTAGE FOLLOWER AND DISPLAY METHOD THEREOF

(71) Applicant: SHENZHEN CHINA STAR OPTOELECTRONICS SEMICONDUCTOR DISPLAY TECHNOLOGY CO., LTD., Shenzhen (CN)

(72) Inventor: Bo Yang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 142 days.

(21) Appl. No.: 16/625,171

(22) PCT Filed: Dec. 3, 2019

(86) PCT No.: PCT/CN2019/122644

§ 371 (c)(1),
(2) Date: Dec. 20, 2019

(87) PCT Pub. No.: WO2021/097911

PCT Pub. Date: May 27, 2021

(65) Prior Publication Data

US 2021/0335279 A1 Oct. 28, 2021

(30) Foreign Application Priority Data

Nov. 22, 2019 (CN) ..... 201911154292.3

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0452* (2013.01);
(Continued)

(58) Field of Classification Search
CPC ..... G09G 3/3291
(Continued)

(56) References Cited

U.S. PATENT DOCUMENTS

2015/0123953 A1 5/2015 Shim et al.
2016/0163255 A1 6/2016 Kim et al.
(Continued)

FOREIGN PATENT DOCUMENTS

CN 104637440 A 5/2015
CN 105788530 A 7/2016
CN 108257561 A 7/2018

*Primary Examiner* — Long D Pham
(74) *Attorney, Agent, or Firm* — Dickinson Wright PLLC

(57) ABSTRACT

The present invention provides a method of driving a display panel and a driving device. The present invention determines sub-pixels shared by sub-pixel rendering technology through comparing differences of the color components, and the sub-pixels shared by the display image are not fixed. Since the sub-pixels with the smallest absolute value of the color component difference are selected for sharing, a contrast of an edge region of an image is improved, and distortion of an edge region of an image is reduced.

16 Claims, 3 Drawing Sheets

(52) U.S. Cl.
CPC ..... *G09G 2310/0278* (2013.01); *G09G 2310/0291* (2013.01)

(58) Field of Classification Search
USPC ..... 345/204
See application file for complete search history.

(56) References Cited

U.S. PATENT DOCUMENTS

| | | | | |
|---|---|---|---|---|
| 2017/0103703 | A1* | 4/2017 | Bi | G09G 3/3291 |
| 2017/0193906 | A1* | 7/2017 | Li | G09G 3/3258 |
| 2017/0372655 | A1 | 12/2017 | Wang et al. | |
| 2018/0190198 | A1* | 7/2018 | Kim | G09G 3/3291 |
| 2020/0013340 | A1 | 1/2020 | Kim | |

* cited by examiner

ORGANIC LIGHT-EMITTING DIODE DISPLAY WITH VOLTAGE FOLLOWER AND DISPLAY METHOD THEREOF

BACKGROUND OF INVENTION

Field of Invention

The present application relates to a field of display technology, and in particular, to an organic light-emitting diode display and a display method thereof.

Description of Prior Art

At present, each sub-pixel of an organic light-emitting diode display mainly includes a driving transistor that drives an organic light-emitting diode, a switching transistor that transmits a data voltage to a gate node of the driving transistor, and a capacitor that maintains a preset voltage for a time period of one frame. Since threshold voltages and electron mobilities of the driving transistors of each sub-pixel are different due to process variation, and electrical performance of the driving transistors will be deteriorated with extension of the driving cycle, further resulting in differences in the threshold voltages and electron mobilities of the driving transistors between different sub-pixels. However, the mutual differences between different driving transistors may cause differences in brightness levels, resulting in non-uniform brightness of the organic light-emitting diode display.

A traditional method is to detect and sample the electrical differences of the driving transistors in the organic light-emitting diode display before image display of the organic light-emitting diode display, and store a sampled data in a memory. When the organic light-emitting diode display needs to display an image, the sampled data is transmitted to a timing controller through a cache module, and a compensation data of the driving transistor is calculated based on the sampled data. The timing controller outputs a control signal to a source driver according to the compensation data, and the source driver outputs the compensation data to a sub-pixel to realize a compensated image display, and improve the brightness uniformity of the picture. That is, the traditional method is to solve the problem of uneven brightness caused by the differences between the driving transistors through external compensation. However, the traditional externally compensated threshold voltage has the problems of long detection time and the need to add an additional detection module, storage module and cache module. Another traditional method is to internally compensate the threshold voltage of the driving transistor. However, after internally compensating the threshold voltage of the driving transistor, there will be a problem of current leakage of the driving transistor, which will impact an acquisition result of the driving threshold voltage.

An object of the present application is to provide an organic light-emitting diode display and a display method thereof, which can reduce an acquisition time of a driving transistor and avoid the problem of current leakage of the driving transistor after acquiring the threshold voltage of the driving transistor.

SUMMARY OF INVENTION

In order to achieve the above object, the present application provides an organic light-emitting diode display, wherein the organic light-emitting diode display includes an organic light-emitting diode display panel and a voltage follower, the organic light-emitting diode display panel including a plurality of data lines, a plurality of scanning lines, and a plurality of pixels, wherein each of the pixels includes at least three sub-pixels, and each of the sub-pixels includes:

a light-emitting element, being an organic light-emitting diode and having one terminal connected to a second node and another terminal connected to a first common voltage terminal;

a driving transistor, having a threshold voltage and having a control terminal connected to a first node, a first terminal connected to a second common voltage terminal, and a second terminal connected to the second node;

a first switch, having a control terminal connected to one of the scan lines, a first terminal connected to one of the data lines, and a second terminal connected to the first node; and a capacitor, connected between the first node and the second node, and configured to store the threshold voltage of the driving transistor during acquiring the threshold voltage, wherein an output terminal of the voltage follower is electrically connected to the second node of at least one of the sub-pixels, and the voltage follower is configured to maintain a voltage of the second node in a preset period after the capacitor acquires the threshold voltage of the driving transistor, and an input terminal of the voltage follower is electrically connected to a preset voltage input terminal, and wherein each of the pixels includes a red sub-pixel, a blue sub-pixel, and a green sub-pixel.

In the above organic light-emitting diode display, the voltage follower includes a first operational amplifier and a second operational amplifier, and a positive input terminal of the first operational amplifier is connected to an input terminal of the voltage follower, a negative input terminal of the second operational amplifier, and an output terminal of the second operational amplifier, the negative input terminal of the first operational amplifier is connected to a output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

In the above organic light-emitting diode display, the voltage follower is electrically connected to the second node in each of the at least three sub-pixels of a same one of the pixels.

In the above organic light-emitting diode display, the organic light-emitting diode display further includes a multi-output selector, which includes at least three second switches and first control signal lines correspondingly connected to each of the second switches, a control terminal of each of the second switches is connected to a corresponding one of the first control signal lines, a first terminal of each of the second switches is connected to an output terminal of the voltage follower, and a second terminal of each of the second switches is electrically connected to the second node of one of the sub-pixels.

In the above organic light-emitting diode display, each of the sub-pixels further includes a third switch having a control terminal connected to a second control signal line, a first terminal connected to the output terminal of the voltage follower, and a second terminal electrically connected to the second node.

In the above organic light-emitting diode display, the organic light-emitting diode display further includes a fourth switch having a control terminal connected to a third control signal line, a first terminal connected to the preset voltage input terminal, and a second terminal connected to the input terminal of the voltage follower.

In the above organic light-emitting diode display, the first switch is a thin film transistor.

The present application further provides an organic light-emitting diode display, and the organic light-emitting diode display includes an organic light-emitting diode display panel and a voltage follower, the organic light-emitting diode display panel including a plurality of data lines, a plurality of scanning lines, and a plurality of pixels, wherein each of the pixels includes at least three sub-pixels, and each of the sub-pixels includes:

a light-emitting element, having one terminal connected to a second node and another terminal connected to a first common voltage terminal;

a driving transistor, having a threshold voltage and having a control terminal connected to a first node, a first terminal connected to a second common voltage terminal, and a second terminal connected to the second node;

a first switch, having a control terminal connected to one of the scan lines, a first terminal connected to one of the data lines, and a second terminal connected to the first node; and a capacitor, connected between the first node and the second node, and configured to store the threshold voltage of the driving transistor during acquiring the threshold voltage, wherein an output terminal of the voltage follower is electrically connected to the second node of at least one of the sub-pixels, and the voltage follower is configured to maintain a voltage of the second node in a preset period after the capacitor acquires the threshold voltage of the driving transistor, and an input terminal of the voltage follower is electrically connected to a preset voltage input terminal.

In the above organic light-emitting diode display, the voltage follower includes a first operational amplifier and a second operational amplifier, and a positive input terminal of the first operational amplifier is connected to an input terminal of the voltage follower, a negative input terminal of the second operational amplifier, and an output terminal of the second operational amplifier, the negative input terminal of the first operational amplifier is connected to an output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

In the above organic light-emitting diode display, the voltage follower is electrically connected to the second node in each of the at least three sub-pixels of a same one of the pixels.

In the above organic light-emitting diode display, the organic light-emitting diode display further includes a multi-output selector, which includes at least three second switches and first control signal lines correspondingly connected to each of the second switches, a control terminal of each of the second switches is connected to a corresponding one of the first control signal lines, a first terminal of each of the second switches is connected to an output terminal of the voltage follower, and a second terminal of each of the second switches is electrically connected to the second node of one of the sub-pixels.

In the above organic light-emitting diode display, each of the sub-pixels further includes a third switch having a control terminal connected to a second control signal line, a first terminal connected to the output terminal of the voltage follower, and a second terminal electrically connected to the second node.

In the above organic light-emitting diode display, the organic light-emitting diode display further includes a fourth switch having a control terminal connected to a third control signal line, a first terminal connected to the preset voltage input terminal, and a second terminal connected to the input terminal of the voltage follower.

In the above organic light-emitting diode display, the first switch is a thin film transistor.

In the above organic light-emitting diode display, the light-emitting element is an organic light-emitting diode.

In the above organic light-emitting diode display, each of the pixels includes a red sub-pixel, a blue sub-pixel, and a green sub-pixel.

The present application also provides a display method of the above organic light-emitting diode display, and the display method includes the following steps:

in a threshold voltage acquiring stage, the voltage follower outputting the preset voltage loaded by the preset voltage input terminal to the second node, turning on the first switch to input a reference voltage loaded by the data lines to the first node, raising a voltage of the second node until a voltage difference between the first node and the second node is the threshold voltage, and the capacitor acquiring the threshold voltage;

in a data voltage writing stage, turning on the first switch to load a data voltage loaded by the data lines to the first node; and in a light-emitting stage, turning on the driving transistor to drive the light-emitting element to emit light.

In the above display method, the voltage follower includes a first operational amplifier and a second operational amplifier, and a positive input terminal of the first operational amplifier is connected to an input terminal of the voltage follower, a negative input terminal of the second operational amplifier, and an output terminal of the second operational amplifier, the negative input terminal of the first operational amplifier is connected to an output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

The present application provides an organic light-emitting diode display and a display method thereof. By setting a voltage follower electrically connected to a second node of a sub-pixel, the problem of current leakage of the driving transistor after the capacitor acquires the threshold voltage is avoided, wherein the voltage follower is configured to maintain a voltage of the second node in a preset period after a capacitor acquires a threshold voltage of the driving transistor. Compared with the conventional technology that detects the threshold voltage externally and compensates the driving voltage by the detection result, the present application compensates the threshold voltage internally, which does not require an additional detection module, storage module, and cache module, and can shorten a time period for compensating the threshold voltage.

DETAILED DESCRIPTION OF PREFERRED EMBODIMENTS

The technical solutions in the embodiments of the present application will be clearly and completely described in the following with reference to the accompanying drawings in the embodiments. It is apparent that the described embodiments are only a part of the embodiments of the present application, and not all of them. All other embodiments obtained by a person skilled in the art based on the embodiments of the present application without creative efforts are within the scope of the present application.

Figure 1:
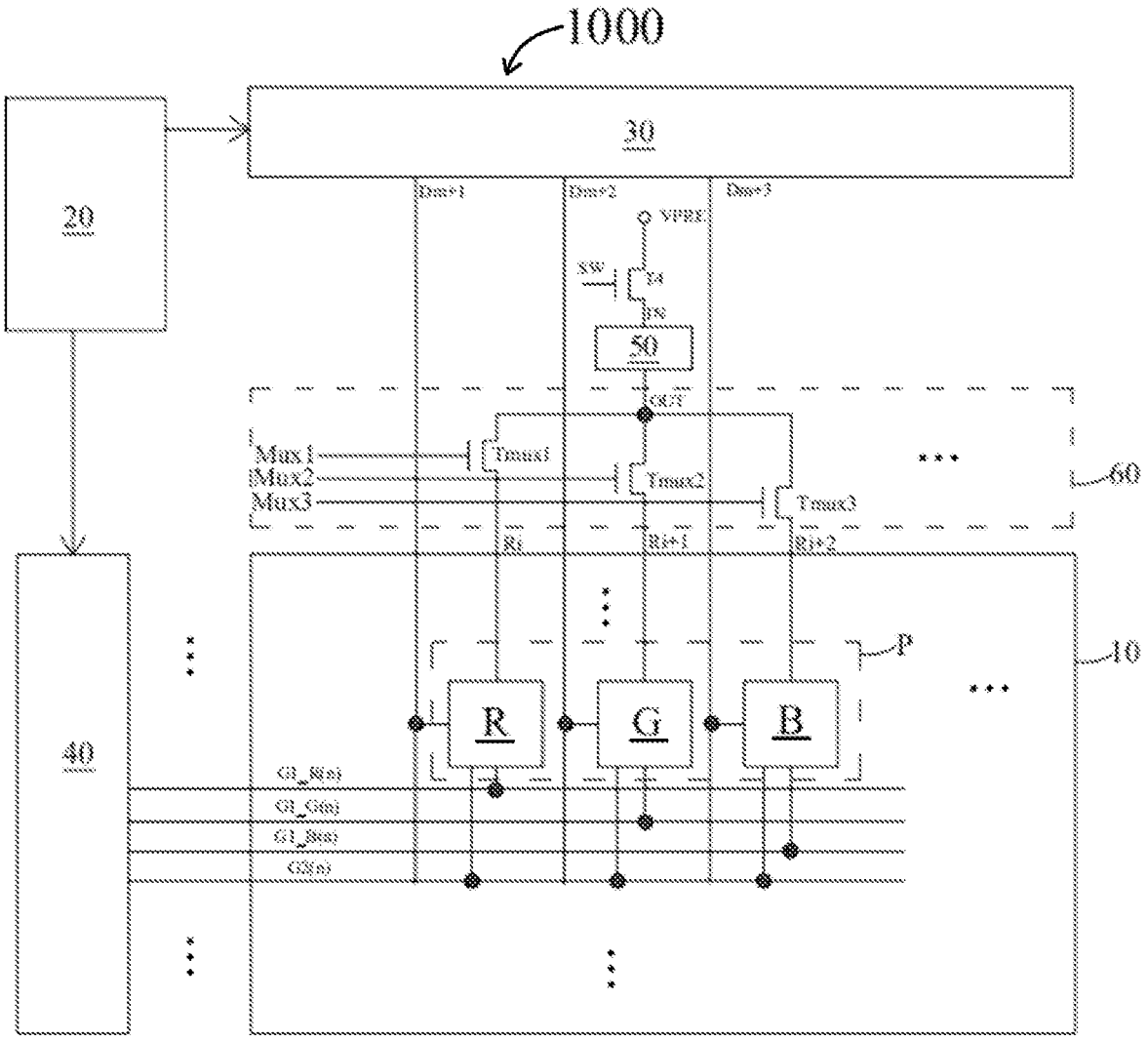
FIG. 1 is a schematic structural diagram of an organic light-emitting diode display according to an embodiment of the present application.

Please refer to FIG. 1, which is a schematic structural diagram of an organic light-emitting diode display according to an embodiment of the present application. The organic light-emitting diode display 1000 includes an organic light-emitting diode display panel 10, a timing controller 20, a source driver 30, a gate driver 40, and a voltage follower 50.

The source driver 30 drives pixels on the organic light-emitting diode display panel 10 to emit light by supplying data voltages to the plurality of data lines D.

The gate driver 40 drives pixels on the organic light-emitting diode display panel 10 to emit light sequentially by sequentially providing scanning signals through a plurality of gate lines. The gate driver 40 may be located on one side of the organic light-emitting diode display panel 10, or the gate driver 40 may also be located on opposite sides of the organic light-emitting diode display panel 10. The gate driver 40 may be a gate drive circuit (gate-on-array, GOA) provided on the organic light-emitting diode display panel 10.

The timing controller 20 receives timing signals (such as a vertical synchronization signal, a horizontal synchronization signal, an input data enable signal, and a clock signal), and generates various control signals. The control signals include various gate control signals. The gate control signals include a gate start pulse signal, a gate shift clock signal, and a gate output enable signal. The gate start pulse signal controls operation start timing of the gate drive chip in the gate driver 40, the gate shift clock signal is a clock signal that controls the scan signal shift timing, and the gate output enable signal assigns a timing information of the gate drive chip in the gate driver. The control signals include various data control signals, including a source start pulse and a source output enable signal. The source start pulse controls the data sampling start timing of the source driver. The source output enable signal controls the output timing of the source driver 30. The timing controller 20 controls the source driver 30 and the gate driver 40 by providing control signals to the source driver 30 and the gate driver 40.

The organic light-emitting diode display panel 10 includes a plurality of data lines, a plurality of scan lines, and a plurality of pixels P. The plurality of data lines include a data line Dm+1, a data line Dm+2, and a data line Dm+3, where m is an integer greater than or equal to 0, and the plurality of data lines are arranged vertically and in parallel. Each of the data lines is connected to a column of sub-pixels. The plurality of scanning lines include a first scanning line G1_R(n), a first scanning line G1_G(n), a first scanning line G1_B(n), and a second scanning line G2(*n*), wherein each of the first scanning line G1_R(n), the first scan line G1_G(n) and the first scan line G1_B(n) is configured to input a scan signal that controls a writing data signal of each of the sub-pixels, and the second scan line G2(*n*) is configured to input a scanning signal that controls to acquire the threshold voltage of the driving transistor of each of the sub-pixels. The plurality of scanning lines are arranged horizontally in parallel, the first scanning line G1_R(n) is connected to the red sub-pixel R of an nth row, the first scanning line G1G(n) is connected to the green sub-pixel G of the nth row, the first scan line G1_B(n) is connected to the blue sub-pixel B of the nth row, and the second scan line G2(*n*) is connected to all the sub-pixels in the nth row.

Each of the pixels P includes at least three sub-pixels. Specifically, each of the pixels P includes a red sub-pixel R, a blue sub-pixel B, and a green sub-pixel G. It can be understood that each of the pixels P may further include a white sub-pixel W.

Figure 2:
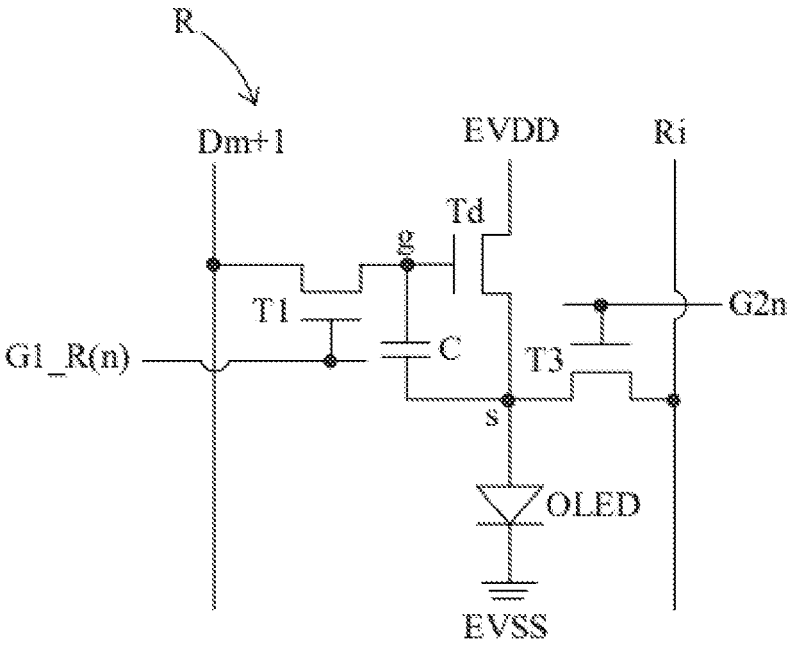
FIG. 2 is a schematic diagram of a red sub-pixel of the organic light-emitting diode display shown in FIG. 1.

The red sub-pixel R will be described in detail below. The constitution of the green sub-pixel G and the blue sub-pixel B is basically the same as that of the red sub-pixel R, and will not be repeated in detail herein for brevity. Please refer to FIG. 2, which is a schematic diagram of a red sub-pixel of the organic light-emitting diode display shown in FIG. 1. The red sub-pixel includes a light-emitting element OLED, a driving transistor Td, a first switch T1, a capacitor C, and a third switch T3.

The light-emitting element OLED emits light when a current passes through it. The light-emitting element OLED is an organic light-emitting diode having one terminal connected to a second node s and another terminal connected to a first common voltage terminal EVSS. The first common voltage terminal EVSS is a ground terminal.

The driving transistor Td is configured to control the magnitude of the current flowing into the light-emitting element OLED to control the brightness of the light-emitting element OLED. The driving transistor Td has a control terminal connected to a first node g, a first terminal connected to a second common voltage terminal EVDD, and a second terminal connected to the second node s, and the driving transistor Td has a threshold voltage Vth. A voltage loaded by the second common voltage terminal EVDD is greater than a voltage loaded by the first common voltage terminal EVSS.

The first switch T1 is configured to control the data signal transmitted by the data line to the first node g. The first switch has a control terminal connected to one of the scan line G1_R(n), a first terminal connected to the data line Dm+1, and a second terminal connected to the first node g.

The third switch T3 has a control terminal connected to the second control signal line, a first terminal electrically connected to the output terminal OUT of the voltage follower 50, and a second terminal connected to the second node s. Specifically, the second control signal line is a second scanning signal line G2*n*. The first terminal of the third switch T3 is connected to the signal transmission line Ri, and a signal transmission line Ri is electrically connected to the output terminal OUT of the voltage follower.

The capacitor C is connected between the first node g and the second node s. The capacitor C is configured to store the threshold voltage Vth of the driving transistor Td during acquiring the threshold voltage to realize the internal compensation of the threshold voltage of the driving transistor Td.

The voltage follower 50 has an input terminal IN and an output terminal OUT. The output terminal OUT of the voltage follower 50 is electrically connected to the second node s of at least one of the sub-pixels. The voltage follower 50 is configured to maintain the voltage of the second node s in a preset period after the capacitor C acquires the threshold voltage Vth of the driving transistor Td. The input terminal of the voltage follower 50 is electrically connected to the preset voltage input terminal VPRE. Because the voltage follower 50 is characterized in high input resistance and low output resistance, the preset voltage loaded from the input terminal IN of the voltage follower 50 is equal to the voltage output from the output terminal OUT of the voltage follower 50, and because the capacitor C maintains the voltage of the second node s in a preset period after the capacitor acquires the threshold voltage of the driving transistor Td, the problem of current leakage of the driving transistor Td will not occur, and it will not impact the driving transistor Td to acquire the threshold voltage Vth. The preset period is a period between the time that the capacitor C acquires the threshold voltage and the time that the data voltage is written to the first node g.

Figure 3:
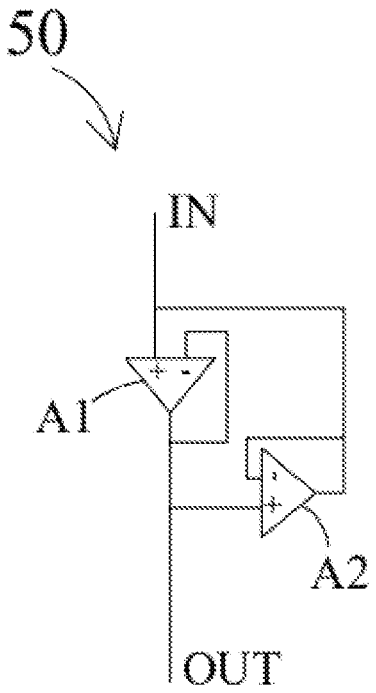
FIG. 3 is a schematic diagram of a voltage follower shown in FIG. 1.

Specifically, referring to FIG. 1 and FIG. 3, FIG. 3 is a schematic diagram of the voltage follower shown in FIG. 1. The voltage follower 50 includes a first operational amplifier A1 and a second operational amplifier A2, wherein a positive input terminal of the first operational amplifier A1 is connected to an input terminal IN of the voltage follower 50, a negative input terminal of the second operational amplifier A2, and an output terminal of the second operational amplifier A2, the negative input terminal of the first operational amplifier A1 is connected to a output terminal of the first operational amplifier A1, a positive input terminal of the second operational amplifier A2 and the output terminal OUT of the voltage follower 50, the negative input terminal of the second operational amplifier A2 is connected to the output terminal of the second operational amplifier A2, the output terminal of the first operational amplifier A1 is connected to the positive input terminal of the second operational amplifier A2, and the positive input terminal of the second operational amplifier A2 is connected to the output terminal OUT of the voltage follower 50.

The voltage follower 50 constituted by the first operational amplifier A1 and the second operational amplifier A2 makes a voltage drop from the input terminal IN to the output terminal OUT of a preset voltage for internal compensation to zero, and the connection between the first operational amplifier A1 and the second operational amplifier constitutes a voltage feedback adjustment circuit. After the capacitor C acquires the threshold voltage Vth of the driving transistor Td, the driving transistor Td is prevented from current leakage, and the voltage of the second node s is maintained. In addition, the positive input terminal of the first operational amplifier A1 inputs the preset voltage for compensation and a high impedance voltage H–Z In this embodiment, one voltage follower 50 is connected to the second nodes s of at least three sub-pixels in a same pixel P. Specifically, one voltage follower 50 is connected to the red sub-pixel R, the blue sub-pixel B, and the green sub-pixel G in the same pixel P. Alternatively, it can be understood that one voltage follower 50 may be connected to one sub-pixel (for example, red sub-pixel R, blue sub-pixel B, or green sub-pixel G) in the same pixel P. Further alternatively, one voltage follower 50 may be connected to a plurality of sub-pixels in two adjacent pixels P. By using at least three sub-pixels in one pixel to share one voltage follower 50, the driving circuit of the pixel is simpler, and power consumption and cost are reduced.

Still referring to FIG. 1, the organic light-emitting diode display 1000 further includes a multi-output selector 60. The multi-output selector 60 is configured to select and switch internal compensation sub-pixels, so as to realize sequentially internal compensation of the sub-pixels in a same row. The multi-output selector 60 includes at least three second switches and a first control signal line correspondingly connected to each of the second switches. A control terminal of each of the second switches is connected to a corresponding first control signal line, and a first terminal of each of the second switches is connected to the output terminal OUT of the voltage follower 50, and a second terminal of each of the second switches is electrically connected to the second node s of one sub-pixel.

Specifically, the at least three second switches include a second switch Tmux1, a second switch Tmux2, and a second switch Tmux3. Correspondingly, the first control signal lines include a first control signal line Mux1, a first control signal line Mux2, and a first control signal line Mux3. The second switch Tmux1 has a control terminal connected to the first control signal line Mux1, a first terminal connected to the output terminal OUT of the voltage follower 50, and a second terminal connected to the first terminal of the third switch T3 of the red sub-pixel R through the signal transmission line Ri. The second switch Tmux2 has a control terminal connected to the first control signal line Mux2, a first terminal connected to the output terminal OUT of the voltage follower 50, and a second terminal connected to the first of the third switch T3 of the green sub-pixel G through the signal transmission line Ri+1. The second switch Tmux3 has a control terminal connected to the first control signal line Mux3, a first terminal connected to the output terminal OUT of the voltage follower 50, and a second terminal connected to a first terminal the third switch of the blue sub-pixel B through the signal transmission line Ri+2.

As shown in FIG. 1, the organic light-emitting diode display further includes a fourth switch T4, which has a control terminal connected to the third control signal line SW, a first terminal connected to the preset voltage input terminal VPRE, and a second terminal connected to the input terminal IN of the voltage follower 50. The fourth switch T4 is configured to control the preset voltage value written by the preset voltage terminal VPRE to be input to the input terminal IN of the voltage follower.

It should be noted that the first switch T1, the second switch, the third switch T3, the fourth switch T4, and the driving transistor Td are all thin film transistors. Specifically, the first switch T1, the second switch, the third switch T3, the fourth switch T4, and the driving transistor Td are all n-type thin film transistors, so the first terminal is a drain and the second terminal is a source. It can be understood that the first switch T1, the second switch, the third switch T3, and the fourth switch T4 may also be p-type thin film transistors.

In the organic light-emitting diode display is provided by an embodiment of the present application, by setting a voltage follower electrically connected to a second node of a sub-pixel, the problem of current leakage of the driving transistor after the capacitor acquires the threshold voltage is avoided, wherein the voltage follower is configured to maintain a voltage of the second node in a preset period after a capacitor acquires a threshold voltage of the driving transistor. Compared with the conventional technology that detects the threshold voltage externally and compensates the driving voltage by the detection result, the present application compensates the threshold voltage internally, which does not require an additional detection module, storage module, and cache module, and can shorten a time period for compensating the threshold voltage.

Figure 4:
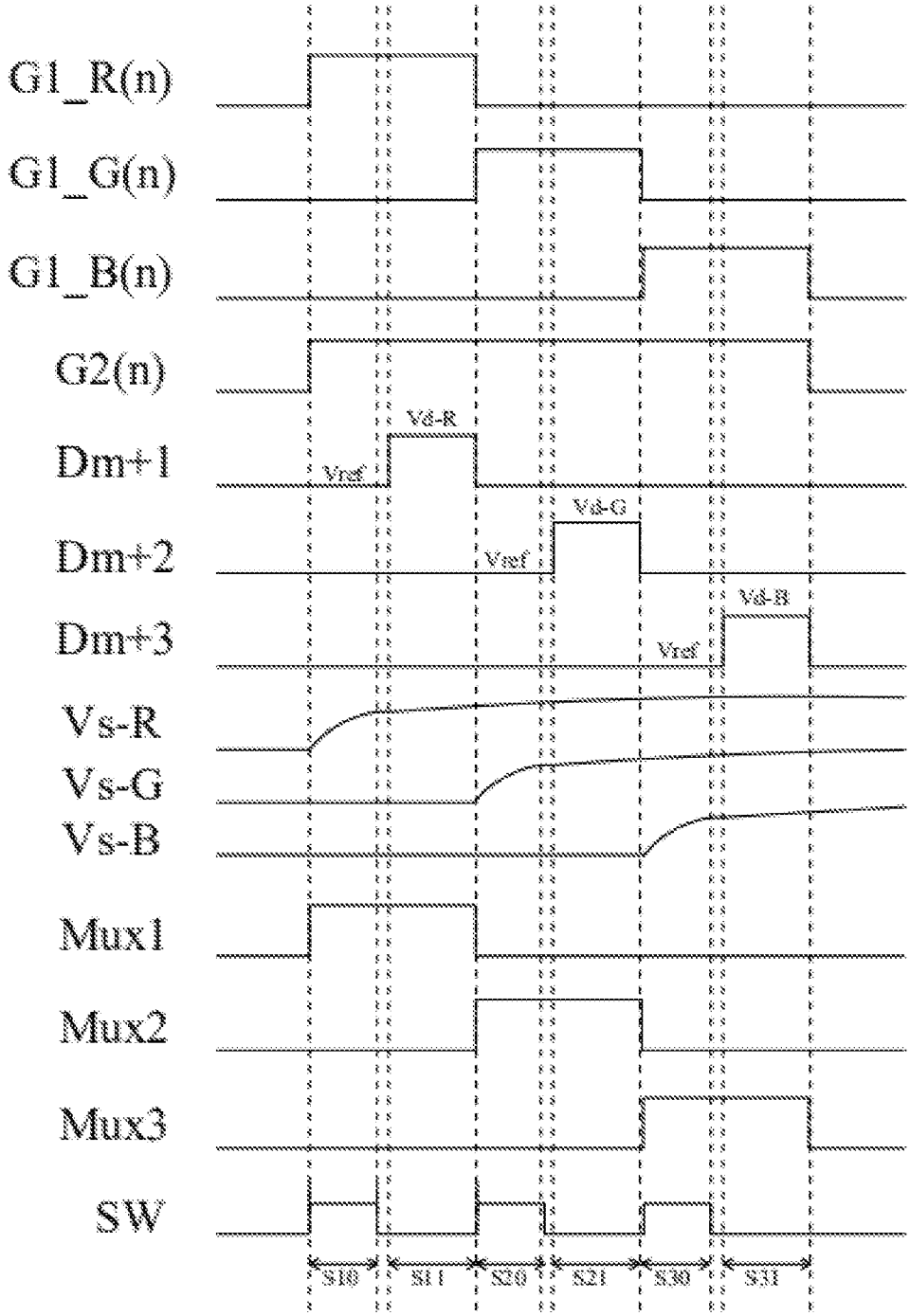
FIG. 4 is a timing diagram when the organic light-emitting diode display shown in FIG. 1 displays.

The present application also provides a display method of the above organic light-emitting diode display. Please refer to FIG. 4, which is a timing diagram when the organic light-emitting diode display shown in FIG. 1 displays. The organic light-emitting diode display includes compensation and light-emitting stages of the red sub-pixel, compensation and light-emitting stages of the green sub-pixel, and compensation and light-emitting stages of the blue sub-pixel.

The compensation and light-emitting stages of the red sub-pixel are as follows:

In a threshold voltage acquiring stage S10, the voltage follower 50 outputs the preset voltage Vpre loaded by the preset voltage input terminal VPRE to the second node s, the first switch T1 is turned on to input a reference voltage Vpre loaded by the data lines to the first node g, a voltage of the second node is raised until a voltage difference between the first node g and the second node s is the threshold voltage Vth, and the capacitor C acquires the threshold voltage Vth.

Specifically, the preset voltage terminal VPRE is loaded with a preset voltage Vpre, the third control signal line SW is loaded with a high electrical-level signal, the fourth switch T4 is turned on, and the preset voltage Vpre is output to the input terminal IN of the voltage follower 50. The voltage follower 50 transmits the preset voltage Vpre to the output terminal OUT of the voltage follower 50. The first control signal line Mux1 is loaded with a high level signal, the second switch Tmux1 is turned on, the second control signal line Mux2 and the second control signal line Mux3 are loaded with a low electrical-level signal, the second switch Tmux2 and the second switch Tmux3 are turned off, and the preset voltage Vpre is output to the first terminal of the third switch T3 of the red sub-pixel R via the second switch Tmux1. The second control signal line G2*n* is loaded with a high electrical-level signal, and the third switch T3 of the red sub-pixel R is turned on to write the preset voltage Vpre to the second node s of the red sub-pixel.

The first scanning signal line G1_R(n) is loaded with a high electrical-level signal, the first switch T1 is turned on to write the reference voltage Vref loaded by the data line Dm+1 to the first node g, the reference voltage Vref is greater than the preset voltage Vpre, the driving transistor Td is turned on, the second common voltage terminal VDD is loaded with a high electrical-level signal to charge the second node s, and the voltage Vs−R of the second node s is increased until a voltage difference between the first node g and the second node s is the threshold voltage Vth of the driving transistor Td, that is, the voltage Vs−R of the second node s is Vref−Vth. The capacitor C in the red sub-pixel R acquires the threshold voltage Vth of the driving transistor Td in the red sub-pixel R.

In a data voltage writing stage S11, the first switch T1 is turned on to load the data voltage Vd−R loaded by the data line Dm+1 to the first node g.

The voltage at the first node g is Vd−R, a voltage difference between the voltage at the first node g and the second node s is Vd−R−Vref+Vth, and the current flowing through the light-emitting element OLED complies with the formula $I=\frac{1}{2}\times K(Vgs-Vth)^2=\frac{1}{2}\times K(Vd-R-Vref)^2$, where K is the electron mobility of the driving transistor Td in the red sub-pixel, Vth is the threshold voltage of the driving transistor in the red sub-pixel, Vgs is the voltage difference between the gate and the source in the driving transistor in the red sub-pixel, and the Vgs is equal to the voltage difference between the first node and the second node. It can be seen that the current flowing through the light-emitting element OLED in the red sub-pixel is independent of the threshold voltage of the driving transistor Td, and the threshold voltage of the driving transistor Td is compensated.

In a light-emitting stage, the driving transistor Td is turned on to drive the light-emitting element OLED to emit light.

Specifically, the driving transistor Td is turned on by the data voltage, a current flows through the light-emitting element OLED, and the light-emitting element OLED of the red sub-pixel R emits light.

The compensation and light-emitting stages of the green sub-pixel are as follows:

In a threshold voltage acquiring stage S20, the voltage follower 50 outputs the preset voltage Vpre loaded by the preset voltage input terminal VPRE to the second node s, the first switch T1 is turned on to input a reference voltage Vpre loaded by the data lines to the first node g, a voltage of the second node is raised until a voltage difference between the first node g and the second node s is the threshold voltage Vth, and the capacitor C acquires the threshold voltage Vth.

Specifically, the preset voltage terminal VPRE is loaded with a preset voltage Vpre, the third control signal line SW is loaded with a high electrical-level signal, the fourth switch T4 is turned on, and the preset voltage Vpre is output to the input terminal IN of the voltage follower 50. The voltage follower 50 transmits the preset voltage Vpre to the output terminal OUT of the voltage follower 50. The first control signal line Mux2 is loaded with a high level signal, the second switch Tmux2 is turned on, the second control signal line Mux1 and the second control signal line Mux3 are loaded with a low electrical-level signal, the second switch Tmux1 and the second switch Tmux3 are turned off, and the preset voltage Vpre is output to the first terminal of the third switch T3 of the green sub-pixel G via the second switch Tmux2. The second control signal line G2*n* is loaded with a high electrical-level signal, and the third switch T3 of the green sub-pixel G is turned on to write the preset voltage Vpre to the second node s of the green sub-pixel.

The first scanning signal line G1_G(n) is loaded with a high electrical-level signal, the first switch T1 is turned on to write the reference voltage Vref loaded by the data line Dm+2 to the first node g, the reference voltage Vref is greater than the preset voltage Vpre, the driving transistor Td is turned on, the second common voltage terminal VDD is loaded with a high electrical-level signal to charge the second node s, and the voltage Vs−G of the second node s is increased until a voltage difference between the first node g and the second node s is the threshold voltage Vth of the driving transistor Td in the green sub-pixel Q that is, the voltage Vs−G of the second node s is Vref−Vth. The capacitor C in the green sub-pixel G acquires the threshold voltage Vth of the driving transistor Td in the green sub-pixel G.

In a data voltage writing stage S21, the first switch T1 is turned on to load the data voltage Vd−G loaded by the data line Dm+2 to the first node g.

The voltage at the first node g is Vd−G, a voltage difference between the voltage at the first node g and the second node s is Vd−G−Vref+Vth, and the current flowing through the light-emitting element OLED complies with the formula $I=\frac{1}{2}\times K(Vgs-Vth)^2=\frac{1}{2}\times K(Vd-G-Vref)^2$, where K is the electron mobility of the driving transistor Td in the green sub-pixel, Vth is the threshold voltage of the driving transistor in the green sub-pixel, Vgs is the voltage difference between the gate and the source in the driving transistor in the green sub-pixel, and the Vgs is equal to the voltage difference between the first node and the second node. It can be seen that the current flowing through the light-emitting element OLED in the green sub-pixel is independent of the threshold voltage of the driving transistor Td, and the threshold voltage of the driving transistor Td of the green sub-pixel G is compensated.

In a light-emitting stage, the driving transistor Td is turned on to drive the light-emitting element OLED to emit light.

Specifically, the driving transistor Td is turned on by the data voltage, a current flows through the light-emitting element OLED, and the light-emitting element OLED of the green sub-pixel G emits light.

The compensation and light-emitting stages of the blue sub-pixels are as follows:

In a threshold voltage acquiring stage S30, the voltage follower 50 outputs the preset voltage Vpre loaded by the preset voltage input terminal VPRE to the second node s, the first switch T1 is turned on to input a reference voltage Vpre loaded by the data lines to the first node g, a voltage of the second node is raised until a voltage difference between the first node g and the second node s is the threshold voltage Vth, and the capacitor C acquires the threshold voltage Vth.

Specifically, the preset voltage terminal VPRE is loaded with a preset voltage Vpre, the third control signal line SW is loaded with a high electrical-level signal, the fourth switch T4 is turned on, and the preset voltage Vpre is output to the input terminal IN of the voltage follower 50. The voltage follower 50 transmits the preset voltage Vpre to the output terminal OUT of the voltage follower 50. The first control signal line Mux3 is loaded with a high level signal, the second switch Tmux3 is turned on, the second control signal line Mux1 and the second control signal line Mux3 are loaded with a low electrical-level signal, the second switch Tmux1 and the second switch Tmux2 are turned off, and the preset voltage Vpre is output to the first terminal of the third switch T3 of the blue sub-pixel B via the second switch Tmux3. The second control signal line G2*n* is loaded with a high electrical-level signal, and the third switch T3 of the blue sub-pixel B is turned on to write the preset voltage Vpre to the second node s of the blue sub-pixel B.

The first scanning signal line G1_B(n) is loaded with a high electrical-level signal, the first switch T1 is turned on to write the reference voltage Vref loaded by the data line Dm+3 to the first node g, the reference voltage Vref is greater than the preset voltage Vpre, the driving transistor Td is turned on, the second common voltage terminal VDD is loaded with a high electrical-level signal to charge the second node s, and the voltage Vs−B of the second node s is increased until a voltage difference between the first node g and the second node s is the threshold voltage Vth of the driving transistor Td in the blue sub-pixel B, that is, the voltage Vs−B of the second node s is Vref−Vth. The capacitor C in the blue sub-pixel B acquires the threshold voltage Vth of the driving transistor Td in the blue sub-pixel B.

In a data voltage writing stage S31, the first switch T1 is turned on to load the data voltage Vd−B loaded by the data line Dm+3 to the first node g.

The voltage at the first node g is Vd−B, a voltage difference between the voltage at the first node g and the second node s is Vd−B-Vref+Vth, and the current flowing through the light-emitting element OLED complies with the formula $I=\frac{1}{2}\times K(Vgs-Vth)^2=\frac{1}{2}\times K(Vd-B-Vref)^2$, where K is the electron mobility of the driving transistor Td in the blue sub-pixel, Vth is the threshold voltage of the driving transistor in the blue sub-pixel, Vgs is the voltage difference between the gate and the source in the driving transistor in the blue sub-pixel, and the Vgs is equal to the voltage difference between the first node and the second node. It can be seen that the current flowing through the light-emitting element OLED in the blue sub-pixel is independent of the threshold voltage of the driving transistor Td, and the threshold voltage of the driving transistor Td of the blue sub-pixel B is compensated.

In a light-emitting stage, the driving transistor Td is turned on to drive the light-emitting element OLED to emit light.

Specifically, the driving transistor Td is turned on by the data voltage, a current flows through the light-emitting element OLED, and the light-emitting element OLED of the blue sub-pixel B emits light.

It can be known from the foregoing that the light emission after the red sub-pixel compensation, the light emission after the green sub-pixel compensation, and the light emission after the blue sub-pixel compensation are sequentially performed to realize the image display of the organic light-emitting diode display.

It should be noted that the preset voltage input terminal VPRE inputs the preset voltage Vpre in the threshold voltage acquiring stage of each of the sub-pixels, and the data voltage writing stage and the light-emitting stage of each of the sub-pixels are in a high-impedance state, so that the voltage of the second node can be maintained after the capacitor acquires the threshold voltage of each of the sub-pixels, to avoid the current leakage of the driving transistor Td before the driving transistor Td receives the data voltage, which impacts the acquisition of the threshold voltage.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. An organic light-emitting diode display, comprising an organic light-emitting diode display panel and a voltage follower, the organic light-emitting diode display panel comprising a plurality of data lines, a plurality of scanning lines, and a plurality of pixels, wherein each of the pixels comprises at least three sub-pixels, and each of the sub-pixels comprises:

a light-emitting element, being an organic light-emitting diode and having one terminal connected to a second node and another terminal connected to a first common voltage terminal;

a driving transistor, having a threshold voltage and having a control terminal connected to a first node, a first terminal connected to a second common voltage terminal, and a second terminal connected to the second node;

a first switch, having a control terminal connected to one of the scan lines, a first terminal connected to one of the data lines, and a second terminal connected to the first node;

a second switch having a control terminal connected to a first control signal line, a first terminal connected to a preset voltage input terminal, and a second terminal connected to an input terminal of the voltage follower; and a capacitor, connected between the first node and the second node, and configured to store the threshold voltage of the driving transistor during acquiring the threshold voltage, wherein an output terminal of the voltage follower is electrically connected to the second node of at least one of the sub-pixels, and the voltage follower is configured to maintain a voltage of the second node in a preset period after the capacitor acquires the threshold voltage of the driving transistor, and the input terminal of the voltage follower is electrically connected to the preset voltage input terminal, and wherein each of the pixels comprises a red sub-pixel, a blue sub-pixel, and a green sub-pixel.

2. The organic light-emitting diode display according to claim 1, wherein the voltage follower comprises a first operational amplifier and a second operational amplifier, and a positive input terminal of the first operational amplifier is connected to the input terminal of the voltage follower, a negative input terminal of the second operational amplifier, and an output terminal of the second operational amplifier, the negative input terminal of the first operational amplifier is connected to a output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

3. The organic light-emitting diode display according to claim 1, wherein the voltage follower is electrically connected to the second node in each of the at least three sub-pixels of a same one of the pixels.

4. The organic light-emitting diode display according to claim 3, wherein the organic light-emitting diode display further comprises a multi-output selector, which comprises at least three third switches and second control signal lines correspondingly connected to each of the third switches, a control terminal of each of the third switches is connected to a corresponding one of the second control signal lines, a first terminal of each of the third switches is connected to an output terminal of the voltage follower, and a second terminal of each of the third switches is electrically connected to the second node of one of the sub-pixels.

5. The organic light-emitting diode display according to claim 1, wherein each of the sub-pixels further comprises a fourth switch having a control terminal connected to a third signal line, a first terminal connected to the output terminal of the voltage follower, and a second terminal electrically connected to the second node.

6. The organic light-emitting diode display according to claim 1, wherein the first switch is a thin film transistor.

7. A display method of the organic light-emitting diode display according to claim 1, comprising the following steps:

in a threshold voltage acquiring stage, the voltage follower outputting the preset voltage loaded by the preset voltage input terminal to the second node, turning on the first switch to input a reference voltage loaded by the data lines to the first node, raising a voltage of the second node until a voltage difference between the first node and the second node is the threshold voltage, and the capacitor acquiring the threshold voltage;

in a data voltage writing stage, turning on the first switch to load a data voltage loaded by the data lines to the first node; and in a light-emitting stage, turning on the driving transistor to drive the light-emitting element to emit light.

8. The display method of the organic light-emitting diode display according to claim 7, wherein the voltage follower comprises a first operational amplifier and a second operational amplifier, and a positive input terminal of the first operational amplifier is connected to the input terminal of the voltage follower, a negative input terminal of the second operational amplifier, and an output terminal of the second operational amplifier, the negative input terminal of the first operational amplifier is connected to an output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

9. An organic light-emitting diode display, comprising an organic light-emitting diode display panel and a voltage follower, the organic light-emitting diode display panel comprising a plurality of data lines, a plurality of scanning lines, and a plurality of pixels, wherein each of the pixels comprises at least three sub-pixels, and each of the sub-pixels comprises:

a light-emitting element, having one terminal connected to a second node and another terminal connected to a first common voltage terminal;

a driving transistor, having a threshold voltage and having a control terminal connected to a first node, a first terminal connected to a second common voltage terminal, and a second terminal connected to the second node;

a first switch, having a control terminal connected to one of the scan lines, a first terminal connected to one of the data lines, and a second terminal connected to the first node;

a second switch having a control terminal connected to a first control signal line, a first terminal connected to a preset voltage input terminal, and a second terminal connected to an input terminal of the voltage follower; and a capacitor, connected between the first node and the second node, and configured to store the threshold voltage of the driving transistor during acquiring the threshold voltage, wherein an output terminal of the voltage follower is electrically connected to the second node of at least one of the sub-pixels, and the voltage follower is configured to maintain a voltage of the second node in a preset period after the capacitor acquires the threshold voltage of the driving transistor, and the input terminal of the voltage follower is electrically connected to the preset voltage input terminal.

10. The organic light-emitting diode display according to claim 9, wherein the voltage follower comprises a first operational amplifier and a second operational amplifier, and a positive input terminal of the first operational amplifier is connected to the input terminal of the voltage follower, a negative input terminal of the second operational amplifier, and an output terminal of the second operational amplifier, the negative input terminal of the first operational amplifier is connected to an output terminal of the first operational amplifier, a positive input terminal of the second operational amplifier and the output terminal of the voltage follower, the negative input terminal of the second operational amplifier is connected to the output terminal of the second operational amplifier, the output terminal of the first operational amplifier is connected to the positive input terminal of the second operational amplifier, and the positive input terminal of the second operational amplifier is connected to the output terminal of the voltage follower.

11. The organic light-emitting diode display according to claim 9, wherein the voltage follower is electrically connected to the second node in each of the at least three sub-pixels of a same one of the pixels.

12. The organic light-emitting diode display according to claim 11, wherein the organic light-emitting diode display further comprises a multi-output selector, which comprises at least three third switches and second control signal lines correspondingly connected to each of the third switches, a control terminal of each of the third switches is connected to a corresponding one of the second control signal lines, a first terminal of each of the third switches is connected to an output terminal of the voltage follower, and a second terminal of each of the third switches is electrically connected to the second node of one of the sub-pixels.

13. The organic light-emitting diode display according to claim 9, wherein each of the sub-pixels further comprises a fourth switch having a control terminal connected to a third control signal line, a first terminal connected to the output terminal of the voltage follower, and a second terminal electrically connected to the second node.

14. The organic light-emitting diode display according to claim 9, wherein the first switch is a thin film transistor.

15. The organic light-emitting diode display according to claim 9, wherein the light-emitting element is an organic light-emitting diode.

16. The organic light-emitting diode display according to claim 9, wherein each of the pixels comprises a red sub-pixel, a blue sub-pixel, and a green sub-pixel.

* * * * *